US006860430B2

(12) United States Patent
Sanchez

(10) Patent No.: US 6,860,430 B2
(45) Date of Patent: Mar. 1, 2005

(54) SPACE HEATING AND COOLING

(75) Inventor: Michael P. Sanchez, Albuquerque, NM (US)

(73) Assignee: Lipidex Corporation, Duxbury, MA (US)

( * ) Notice: Subject to any disclaimer, the term of this patent is extended or adjusted under 35 U.S.C. 154(b) by 0 days.

(21) Appl. No.: 10/328,945

(22) Filed: Dec. 24, 2002

(65) Prior Publication Data

US 2004/0118932 A1 Jun. 24, 2004

(51) Int. Cl.[7] ..... F25B 29/00
(52) U.S. Cl. ..... 236/11; 237/19
(58) Field of Search ..... 236/11, 10, 49.3; 454/239; 237/19

(56) References Cited

U.S. PATENT DOCUMENTS 2,224,946 A * 12/1940 Appel ..... 236/11 X
4,136,730 A * 1/1979 Kinsey ..... 62/231 X
5,582,233 A * 12/1996 Noto ..... 236/11 X
6,431,268 B1 * 8/2002 Rudd ..... 165/223

* cited by examiner

*Primary Examiner*—Harry B. Tanner
(74) *Attorney, Agent, or Firm*—Fish & Richardson P.C.

(57) ABSTRACT

An air handler operates alternately in (a) a heating state at times when air in a space in a building is at an actual temperature that is insufficient relative to a set temperature and (b) a non-heating state at times when the air in the space is at an actual temperature that is sufficient relative to a set temperature, and at least sometimes during the non-heating state, delivering heated air to the space.

32 Claims, 3 Drawing Sheets

SPACE HEATING AND COOLING

This description relates to space heating and cooling.

During the 1990s, the United States Department of Energy sponsored research on how to save energy in heating and cooling houses and other buildings. As shown in FIG. 1, one recommendation that has begun to be widely adopted is to super-insulate buildings, seal them tightly against air infiltration, and use a vent 10 from the outside world 12 to let in fresh air. The fresh air is needed to clear odors and humidity from the tightly-sealed spaces 14 that are occupied within the buildings. The energy savings produced by such a system are so large that it is expected that, in the future, most new buildings will be super-insulated and tightly sealed.

Drawing additional air into a tight building creates a positive internal pressure. Some super-insulated buildings have exhaust vents that relieve the excess pressure to the outside world. One low-cost approach is to automatically turn on an existing bathroom fan when the central fan is turned on or when a motorized damper in the outside air vent is opened. Because the exhaust air tends be cooler (if air conditioned) or warmer (if heated) than the outside air, some buildings have a heat exchanger to transfer heat from the air being vented outside to the air being drawn in through the fresh air vent, to save energy.

In many cases, because even a tightly sealed building has leaks or other avenues for venting small amounts of air, it is not necessary to provide an exhaust vent or the associated heat exchanger. Instead it is possible to run what is called an unbalanced system.

As is typical of forced air heating or cooling systems, the heater or cooler 16, 18 (and a central fan 20) is turned on and off in response to a thermostat and controller 22 (sometimes called just a controller below) based on a comparison of a set point temperature and a current air temperature measured at a temperature sensor 24. The central fan 20 forces air from the heater or cooler through ducts 26 into the occupied spaces 14. Stale air is withdrawn from the space through a set of return ducts 27 and returned to the heater or cooler. As long as the heater or cooler is running, the stale returned air is supplemented with fresh air that is drawn into the building through the vent 10. A damper 28 inside vent 10 is set in a fixed position to permit no more than a suitable amount of fresh air to be drawn in while the heater or cooler is running.

Even during intervals when the heater or cooler is not running, fresh air continues to be needed, and for this purpose, the central fan may be run from time to time during those intervals.

Heating and cooling systems are generally sized so that they run almost full-time during the coldest or warmest months. When a system that draws in fresh air from the outside world runs all the time, more air is drawn in than is needed for air exchange purposes, and energy is wasted in heating or cooling it. By motorizing the damper 28, it is possible to open and close the damper in cycles to reduce the amount of fresh air drawn into the building. By an appropriate control arrangement, the average "on" duty cycle of the damper can be varied depending on the average "on" duty cycle of the heater or cooler. The damper is opened any time the fan is running for heating, cooling or fan cycling.

The cooler and/or heater are part of what is often called an air handler 32, which may also include a humidifier and/or a dehumidifier 34, and a wide variety of other equipment. A wide variety of configurations are used for air handlers, the equipment that is in them, and the equipment to which they are connected.

The air in the air handler can be heated and/or cooled in a wide variety of ways. A conventional cooler includes the heat exchanger 18, a compressor 36 located outside the building, a delivery conduit 38 with a pump 40 to force coolant from the compressor to the exchanger and a return conduit 42 to carry used coolant back to the compressor. The pump is controlled by the controller 22.

Although the heater can be a conventional burner governed by the controller 22, in some super-insulated buildings, the amount of heat needed to heat the occupied spaces is low enough that the heat can be drawn from domestic hot water in a heat exchanger 16. The water is heated in a domestic hot water heater 44 and forced to the heat exchanger 16 through a delivery conduit 46 by a pump 48 under the control of controller 22. The water returns from the exchanger to the heater 44 in a return conduit 50 that may join with the cold-water inlet 52. A set of pipes 54 also deliver domestic hot water to parts of the building where it is to be used. When heat is required in the building, the controller causes pump 48 to deliver hot water to the heat exchanger.

During months when the heater or cooler is not operating for long periods of time, the water in the conduits 46 and 50 and in the exchanger is not being pumped and stagnates making it unsuitable for drinking when it later finds its way back to the hot water heater 44. To prevent stagnation, a controller 22 may cycle the pump 48 occasionally, even during periods when no heat or cooling is being called for.

If too much heat is drawn from the domestic water by the exchanger 16, the water may become too cold for domestic use. Some controllers 22 will give priority to domestic hot water usage by temporarily preventing the pumping of significant volumes of hot water from the hot water heater to the exchanger when the temperature of the water is too low. For this purpose a temperature sensor 47 in the conduit 46 is connected to the controller 22.

In general, in one aspect, the invention features a method that includes (i) causing an air handler to operate alternately in (a) a heating state at times when air in a space in a building is at an actual temperature that is insufficient relative to a set temperature and (b) a non-heating state at times when the air in the space is at an actual temperature that is sufficient relative to a set temperature, and (ii) at least sometimes during the non-heating state, delivering heated air to the space.

Implementations of the invention may include one or more of the following features. The air to be delivered to the space is heated by providing heat, e.g., domestic hot water from a water heater, to a heat exchanger. The providing of the hot water is interrupted based on a call for domestic hot water from the domestic water heater. The heat is provided in pulses that include priming pulses that precede times when a central fan is turned on. During the non-heating state, the delivery of heated air is insufficient to raise the temperature of the space to meet the set temperature. The heated air is not delivered to the space for a period at the beginning of the non-heating state. During the heating state, a central fan forces heated air into the space to cause the temperature in the space to become sufficient relative to the set temperature. The heated air is delivered by a fan. The heated air is drawn from outside the space.

In general, in another aspect, the invention features apparatus that includes ports to communicate heating signals to and from sensors and heating equipment, and a processor to control the heating equipment to (i) operate alternately in (a) a heating state at times when air in a space in a building is at an actual temperature that is insufficient relative to a set temperature and (b) a non-heating state at times when the air in the space is at an actual temperature that is sufficient relative to a set temperature, and (ii) at least sometimes during the non-heating state, to deliver heated air to the space.

Implementations of the invention may include one or more of the following features. The apparatus includes storage to hold data and instructions for use by the processor, and also includes a user interface.

In general, in another aspect, the invention features a medium bearing instructions to enable a machine to: cause an air handler to operate alternately in (a) a heating state at times when air in a space in a building is at an actual temperature that is insufficient relative to a set temperature and (b) a non-heating state at times when the air in the space is at an actual temperature that is sufficient relative to a set temperature, and at least sometimes during the non-heating state, deliver heated air to the space.

Other advantages and features will become apparent from the following description and from the claims.

Figure 1:
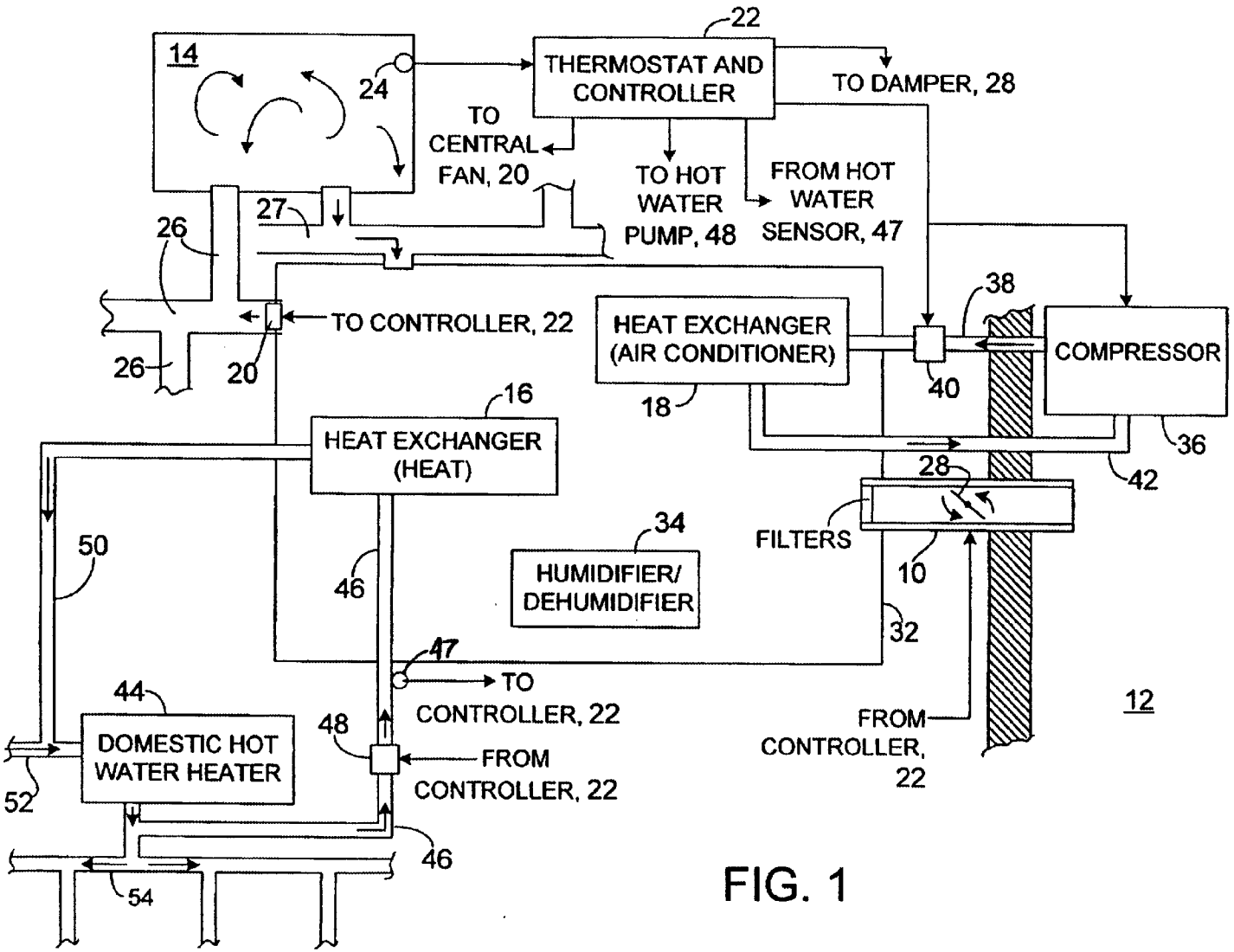
FIG. 1 is a schematic diagram of a space heating and cooling system.

For heating purposes, a system of the kind shown in FIG. 1 typically operates in two alternating states.

One state is a heating state in which the heat exchanger 16 uses (in this example) domestic hot water to heat air (including recirculated air and fresh air) which is then blown by the central fan through ducts into the occupied space of the building. (The phrase "occupied space" implies that the goal is to make the occupants of the space more comfortable, but, of course, the space may not actually be occupied at a given time.) The start of the heating state is typically triggered by the thermostat and controller 22 when the temperature of the occupied space drops below a setpoint temperature. The heating state is ended by the thermostat and controller when the temperature of the occupied space rises again to the setpoint. (In typical systems, a dead band is defined that requires the temperature of the occupied space to fall by some amount lower than the setpoint before the heating state starts and/or for the temperature to rise by some amount higher than the setpoint before the heating state ends; but, for simplicity, our discussion disregards the existence of the dead band.) During the heating state (and except at times when the demand for domestic hot water is given priority over the call for heat), the heat exchanger is continuously on, domestic hot water is being continuously pumped to the heat exchanger, and the central fan is continuously on. The goal during the heating state (also called the heating period) is to raise the temperature in the occupied space to the setpoint as quickly as possible.

The other state, the non-heating state, occurs in the periods (called non-heating periods) between the heating periods. During the non-heating state, the central fan is typically turned on and off in successive cycles to deliver fresh air to the occupied space. The fresh air being delivered to the occupied space (by which we mean possibly both air from the outside and/or air that is recirculated from the occupied space) may be uncomfortably cool to the occupants.

This effect may be reduced by, for example, cycling the hot water pump 48 on and off to deliver occasional small amounts of hot water to the heat exchanger during the non-heating state. Pumping small amounts of domestic hot water enables the heat exchanger to heat the fresh air slightly to remove the chill, making the occupants of the space more comfortable. The goal of the pump cycling is not to drive the temperature in the occupied space toward the setpoint, or even to increase the temperature in the occupied space by any noticeable amount. Rather the goal is to condition the fresh air by heating it slightly so that it doesn't feel uncomfortable to occupants as it enters the room. For this reason, it is useful to minimize the amount of heat that is being drawn from the hot water during the non-heating state consistent with making the occupants comfortable.

Figure 2:
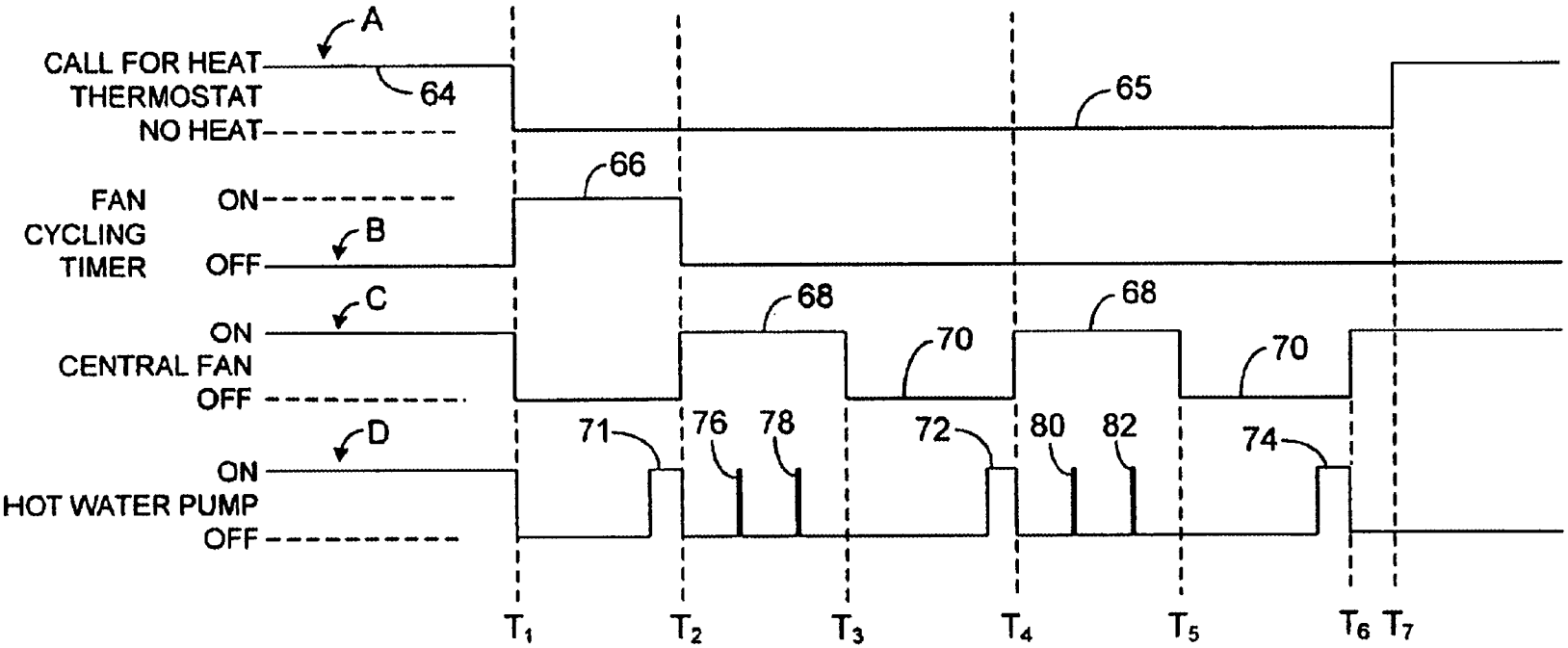
FIG. 2 is a timing diagram.

FIG. 2 shows the time sequence of events for a period 65 of a non-heating state in which the thermostat is not calling for heat (shown in A of FIG. 2) following a period 64 of a heating state in which the thermostat is calling for heat. Time T1 marks the beginning of the non-heating state. At time T1, when the thermostat stops calling for heat, the central fan 20 and the hot water pump 48 are turned off (C and D in FIG. 2). Also at time T1, a transitional timer is turned on (B in FIG. 2) and runs for a timer period 66, ending at time T2. The timer period may be preset at a fixed amount, for example, 20 minutes, or may be determined by the user or the builder or architect with respect a particular building. The transitional period may not be required.

Between time T2 and the end of the non-heating period 65, the central fan is repeatedly turned on, at times T2, T4, and T6, for predetermined periods 68 each lasting, for example, 10 minutes and turned off at times T3, T5 for predetermined or user set periods 70 each lasting, for example, 20 minutes. (Note that the respective periods shown in FIG. 2 are not to scale for these examples.) The on periods of the central fan provide fresh air to the occupied space even though there is no call for heat.

To take the chill off the fresh air being delivered to the occupied space by the central fan during the non-heating periods, the domestic hot water pump is turned on for short pumping periods during the non-heating periods. The pumping periods include priming periods 71, 72, 74 of, for example, 30 seconds each, that occur just before each time T2, T4, T6 when the central fan is turned. The priming period warms the heat exchanger to enable it to take the chill off the fresh air immediately when the central fan is turned on.

The pumping periods also include shorter periods 76, 78, 80, 82 of, for example, 5 seconds each, separated by longer periods of no pumping, for example, 120 seconds each. The shorter pumping periods 76, 78, 80, 82 maintain a small amount of heat in the heat exchanger to enable it to continue to warm the fresh air slightly while the central fan is running.

At times when domestic hot water is being used, the pumping periods may be suspended, just as they may be suspended briefly for the same purpose during heating periods.

Sometimes, the temperature in the occupied space may rise significantly higher than the set point and the space becomes uncomfortably hot. This could happen, for example, during the spring or fall when the outside temperature is rising rapidly and the air handler unintentionally delivers too much heat to the space. The controller can be set up to stop the pump cycling in such instances so that no more heat is added to the space during the non-heating periods. Other fail-safe features may also be provided.

Figure 3:
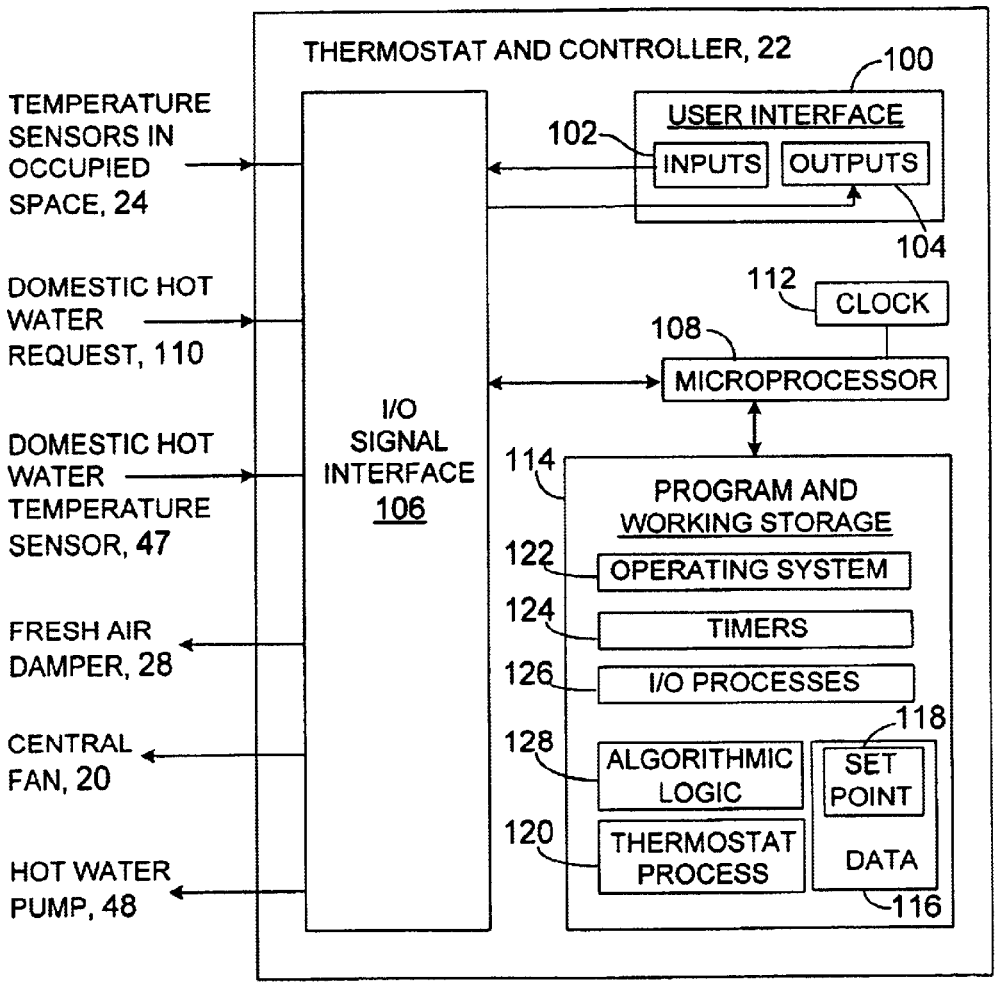
FIG. 3 is a schematic diagram of a thermostat and controller.

As shown in FIG. 3, the thermostat and controller 22 may be implemented as a wall mounted unit that includes a user interface 100 having inputs 102 (such as control buttons) and outputs 104 (such as lights and LED displays). An I/O signal interface 106 handles the delivery of user interface signals back and forth between the user interface and a microprocessor 108. The I/O signal interface 106 is also connected to handle signals to and from temperature sensors in occupied spaces 24, a device that signals requests 110 for domestic hot water, a domestic hot water temperature sensor 47, the fresh air damper motor 28, the central fan 20, and the hot water pump 48. The microprocessor is cadenced by a clock 112 and is connected to a non-volatile program and working storage 114, for example, an EEPROM. The storage contains data 116 such as a set point 118 and other fixed and dynamic parameters that are needed for the control algorithms. The storage also contains executable programs including a conventional thermostat process 120 that switches the system between heating and non-heating states based on the set point and the temperature in the occupied space, an operating system 122, timers 124, I/O processes 126 that manage the incoming and outgoing control signals through the signal interface, and algorithmic logic 128 that enables the controller to manage the system. The algorithms include, for example, those that control the central fan during heating states and non-heating states, the hot water pump during heating and non-heating states, the fresh air damper in the fresh air vent, taking account of, for example, the temperature in the occupied space, requests for domestic heat, and the temperature of the hot water.

The user interface can receive instructions from the user concerning the heated air that is delivered during the non-heating state, for example, instructions that set the length of the priming period, the length of the pumping intervals, and the lengths of the periods between pumping intervals. The interface could also provide information to the user concerning the heated air delivered during the non-heating periods.

Although particular implementations have been described, other implementations are also within the scope of the following claims.

The technique need not be limited to use with air handlers that use domestic hot water for heating. Any kind of heating system can benefit from the technique if it can be controlled to provide small amounts of heat during the air circulation periods when there is no call for heat.

The periods 68 and 70 can be determined in various ways based on configuration settings determined by a user, builder, or architect.

The periods need not be of the same length during a given one of the non-heating periods, nor between different ones of the non-heating periods. The rate at which heat needs to be added to the fresh air during the non-heating state may be determined by experiment and may vary from building to building, space to space, and geographic area to geographic area and also based on the sizes, configurations, and other details of the air handler and other equipment used in a given building.

The priming periods could be eliminated. The user could be permitted to provide input indicating how the system should be controlled for greatest comfort.

The controller can be implemented as any combination of hardware, firmware, and software using a variety of platforms and operating systems.

What is claimed is:

1. A method comprising causing an air handler to operate alternately in a heating state and a non-heating state based on a sensed temperature in a space being heated and on a set temperature, and at least sometimes during the non-heating state, adding heat to the air handler to heat air and delivering the heated air to the space during timed periods.

2. The method of claim 1 in which heating the air includes providing heat to a heat exchanger.

3. The method of claim 2 in which providing heat to a heat exchanger includes providing hot water to the heat exchanger.

4. The method of claim 3 in which providing hot water includes providing hot water from a domestic water heater.

5. The method of claim 4 also including interrupting the providing of the hot water based on a call for domestic hot water from the domestic water heater.

6. The method of claim 2 in which providing heat to a heat exchanger includes providing the heat in pulses.

7. The method of claim 6 in which the pulses include priming pulses that precede times when a central fan is turned on.

8. The method of claim 1 in which, during the non-heating state, the delivery of heated air is insufficient to raise the temperature of the space to meet the set temperature.

9. The method of claim 1 in which, heated air is not delivered to the space for a period at the beginning of the non-heating state.

10. The method of claim 1 in which, during the heating state, a central fan forces heated air into the space to cause the temperature in the space to become sufficient relative to the set temperature.

11. The method of claim 1 in which an actual temperature being insufficient relative to the set temperature comprises the actual temperature being essentially lower than the set temperature.

12. The method of claim 1 in which an actual temperature being sufficient relative to the set temperature comprises the actual temperature being essentially higher than the set temperature.

13. The method of claim 1 in which the heated air is delivered by a fan.

14. The method of claim 1 in which the air that is to be heated is drawn from outside the space.

15. The method of claim 1 also including adding heat in pulses that precede times when a central fan is turned on.

16. The method of claim 1 in which adding heat comprises adding heat in pulses.

17. A method comprising causing an air handler to operate alternately in a heating state and a non-heating state based on a sensed temperature in a space being heated and on a set temperature, and at least sometimes during the non-heating state, heating the air to be delivered to the space by providing domestic hot water in pulses to a heat exchanger and delivering the heated air to the space, the delivery of heated air being insufficient to raise the temperature of the space to meet the set temperature.

18. Apparatus comprising:

ports to communicate heating signals to and from sensors and heating equipment, a processor to control the heating equipment to operate alternately in a heating state and a non-heating state based on a sensed temperature in a space being heated and on a set temperature, and at least sometimes during the non-heating state, adding heat to the air handler to heat air and delivering the heated air to the space during timed periods.

19. The apparatus of claim 18 also including storage to hold data and instructions for use by the processor.

20. The apparatus of claim 18 also including a user interface.

21. The apparatus of claim 18 in which the processor also controls the heating equipment to heat the air to be delivered to the space.

22. The apparatus of claim 18 in which the processor also interrupt the interrupts a providing of domestic hot water to the heating equipment based on a call for domestic hot water from a domestic water heater.

23. The apparatus of claim 18 in which the processor also causes the added heat in pulses to be provided.

24. The apparatus of claim 23 in which the pulses include priming pulses that precede times when a central fan is turned on.

25. The apparatus of claim 18 in which, during the non-heating state, the delivery of heated air is insufficient to raise the temperature of the space to meet the set temperature.

26. The apparatus of claim 18 in which the processor also controls the heating equipment so that heated air is not delivered to the space for a period at the beginning of the non-heating state.

27. The apparatus of claim 18 in which the processor also controls the heating equipment so that, during the heating state, a central fan forces heated air into the space to cause the temperature in the space to become sufficient relative to the set temperature.

28. A medium bearing instructions to enable a machine to:

cause an air handler to operate alternately in a heating state and a non-heating state based on a sensed temperature in a space being heated and on a set temperature, and at least sometimes during the non-heating state, add heat to the air handler to heat air and deliver the heated air to the space during timed periods.

29. A method comprising causing an air handler to operate alternately in a heating state and a non-heating state based on a sensed temperature in a space being heated and on a set temperature, at least sometimes during the non-heating state, adding heat to the air handler to heat air using hot water from a domestic water heater and delivering the heated air to the space, and interrupting the adding of heat using hot water based on a call for domestic hot water from the domestic water heater.

30. A method comprising causing an air handler to operate alternately in a heating state and a non-heating state based on a sensed temperature in a space being heated and on a set temperature, and at least sometimes during the non-heating state, adding heat in pulses to the air handler to heat air and delivering the heated air to the space.

31. A method comprising causing an air handler to operate alternately in a heating state and a non-heating state based on a sensed temperature in a space being heated and on a set temperature, at least sometimes during the non-heating state, adding heat to the air handler to heat air and delivering the heated air to the space, and adding heat to the air handler in pulses that precede times when a central fan is turned on.

32. A method comprising causing an air handler to operate alternately in a heating state and a non-heating state based on a sensed temperature in a space being heated and on a set temperature, at least sometimes during the non-heating state, adding heat to the air handler to heat air using hot water from a domestic water heater and delivering the heated air to the space, the heated air not being delivered to the space for a period at the beginning of the non-heating state.

* * * * *

UNITED STATES PATENT AND TRADEMARK OFFICE

CERTIFICATE OF CORRECTION

PATENT NO. : 6,860,430 B2
DATED : March 1, 2005
INVENTOR(S) : Michael P. Sanchez It is certified that error appears in the above-identified patent and that said Letters Patent is hereby corrected as shown below:

Column 7,
Line 5, before "interrupts", delete "interrupt the".

Signed and Sealed this

Sixteenth Day of August, 2005

JON W. DUDAS
*Director of the United States Patent and Trademark Office*